US005313776A

United States Patent [19]

Humbrecht et al.

[11] Patent Number: 5,313,776

[45] Date of Patent: May 24, 1994

[54] PROCESS FOR MANUFACTURING AN ELASTIC BULK YARN

[75] Inventors: Rémy Humbrecht, Littau; Wolfgang Morgenstern, Kriens, both of Switzerland

[73] Assignee: Rhone-Poulenc Viscosuisse SA, Emmenbrücke, Switzerland

[21] Appl. No.: 795,299

[22] Filed: Nov. 20, 1991

Related U.S. Application Data

[63] Continuation-in-part of Ser. No. 391,530, Jul. 13, 1989, abandoned.

[30] Foreign Application Priority Data

Nov. 17, 1987 [CH] Switzerland ..... 4469/87

[51] Int. Cl.[5] ..... D02G 1/02; D01H 13/28

[52] U.S. Cl. ..... 57/287; 57/247; 57/284; 57/285

[58] Field of Search ..... 57/208, 246, 247, 284, 57/285, 287

[56] References Cited

U.S. PATENT DOCUMENTS

| | | | |
|---|---|---|---|
| 3,797,221 | 3/1974 | Ikeda et al. | 57/288 X |
| 3,886,722 | 6/1975 | Nori et al. | 57/288 |
| 3,936,999 | 2/1976 | Ikeda et al. | 57/288 X |
| 3,938,314 | 2/1976 | Trammell | 57/287 |
| 3,991,548 | 11/1976 | Toronyi et al. | 57/205 |
| 3,995,420 | 12/1976 | Ohse et al. | 57/290 X |
| 4,044,541 | 8/1977 | Ikeda | 57/247 X |
| 4,170,867 | 10/1979 | Leininger | 57/247 X |
| 4,464,894 | 8/1984 | Leininger | 57/284 X |
| 4,505,100 | 3/1985 | Yoshiyuki et al. | 57/207 |
| 4,534,164 | 8/1985 | Toshimasa et al. | 57/284 X |
| 4,648,240 | 3/1987 | Hallsworth et al. | 57/287 X |
| 4,674,273 | 6/1987 | Clements et al. | 57/287 |
| 4,682,465 | 7/1987 | Kojima et al. | 57/247 |

FOREIGN PATENT DOCUMENTS

| | | | |
|---|---|---|---|
| 8904885 | 6/1989 | PCT Int'l Appl. | 57/284 |

*Primary Examiner*—Daniel P. Stodola
*Assistant Examiner*—William Stryjewski
*Attorney, Agent, or Firm*—Felfe & Lynch

[57] ABSTRACT

A friction-textured elastic yarn is prepared by twisting a single-component multifilament melt-spinnable polymer yarn having an initial modulus of 80 to 150 cN/tex and a melting point of at least 200° C. at a speed of at least 200 m/min, the thus twisted yarn is heat-set at 160° to 190° C. to produce a fixated yarn, and the fixated yarn is friction-textured at a pretension of 0.5 to 3.0 cN/tex.

1 Claim, 3 Drawing Sheets

PROCESS FOR MANUFACTURING AN ELASTIC BULK YARN

This is a continuation-in-part of application Ser. No. 07/391,530, filed Jul. 13, 1989, now abandoned.

FIELD OF THE INVENTION

This invention relates to a novel method of manufacturing a friction-textured elastic yarn by twisting a single-component multifilament melt-spinnable yarn, heat-setting the twisted yarn to produce a fixated yarn, and friction-texturing the fixated yarn.

BACKGROUND OF THE INVENTION

High elastic fibers, so-called elastomeric fibers made of rubber as well as of thermoplastic plastics, are known. Thus, the elastane fibers, which belong to the elastomeric fibers, exhibit unsatisfactory textile properties if they consist of bonded multifilaments.

The manufacture of such elastomer fibers requires special measures. As a rule, the fibers are subjected to a wrapping or twisting process before processing. Elastomers of this kind cannot be used alone since the textile planar structure exhibits a greasy appearance. Therefore, elastomeric fibers are always manufactured into a composite yarn together with different chemical fibers such as nylon or polyester (DE-A-24 12 592). This involves a high amount of labor and cost in many operational steps of the manufacture and results in poor economic efficiency.

Attempts of texturing by means of a carrier spindle have so far failed in that the elongation potential of the yarn reaches the limit and the yarn cannot be pulled over a twist pin. Other attempts to texture elastomers by means of friction units have so far not yielded a textured yarn.

OBJECT OF THE INVENTION

It is an object of the invention to provide a simple process which imparts textile and highly elastic properties to a single-component multifilament elastomeric yarn which is not bonded together.

Other objects and advantages of the present invention will become apparent as the description thereof proceeds.

DESCRIPTION OF THE INVENTION

The above object is achieved in accordance with the present invention by twisting a single-component multifilament meltspinnable polyester, polyetherester, polyetheresteramide or polyetheramide yarn having an initial modulus of 80 to 150 cN/tex and a melting point of at least 200° C. at a speed of at least 200 m/min, heat-setting the twisted yarn at 140° to 190° C. to produce a fixated yarn, and friction-texturing the fixated yarn at a pretension of 0.5 to 3.0 cN/tex.

For the first time, an elastomeric multifilament yarn was successfully textured. The textured elastomeric yarns exhibit a higher elongation potential and a hardly changed strength; also, the course of elongation is flatter and more regular as compared to a flat elastomeric yarn. The textile character of the high elastic bulk yarn which is produced has the advantage that it can be directly manufactured into a textile planar structure.

It is advantageous to twist up the multifilament yarn at a speed of at least 200 m/min and texture the fixated yarn which is heat set at 140° to 190° C., preferably at 160° to 190° C., at a tension before the texturing unit of 0.5 to 3.0 cN/tex, preferably 1.0 to 2.0 cN/tex by means of a friction texturing disk unit. Preferably, a POSITORQ® unit with a positive yarn feed is used for friction texturing; hence, the yarn exhibits less tension after the unit. POSITORQ® is a trademark of Rieter-Scragg Ltd., Longley, Cheshire, United Kingdom, applied to a texturing device with at least three friction disks.

The multifilament bulk yarn obtained is distinguished by high elasticity and homogenous fibrils which are not bonded together.

The block copolymers polyetherester, polyesterester, polyetheresteramides, and polyamides proved to be suitable as a starting material for texturing. Polyalkyleneoxides or aliphatic polyesters made of dicarboxylic acids or their alkylesters and diols, dimers of fatty acid esters, and so on as well as polycaprolactones are suitable as soft segments; polyalkyleneterephthalates such as polyethyleneterephthalate and polybutyleneterephthalate which can be additionally modified by comonomers like isophthalic acid or polyamides, can be used as hard segments. The melting point of the bulk yarn in accordance with the invention is at least 200° C. The flat yarns are manufactured by melt spinning of these polymers in a spinning/stretching process. They are characterized by a significantly higher initial modulus of 80 to 150 cN/tex as compared to the known elastane fibers and by a permanent elongation of preferably 10 to 15%, 25% at a maximum, referred to the length of the non-elongated yarn.

The bulk yarn thus obtained is characterized by a degree of crimp of at least 40% and a crimp resistance greater than 50%.

BRIEF DESCRIPTION OF THE DRAWINGS

The invention is explained in greater detail with the aid of the drawings.

They show.

Figure 1:
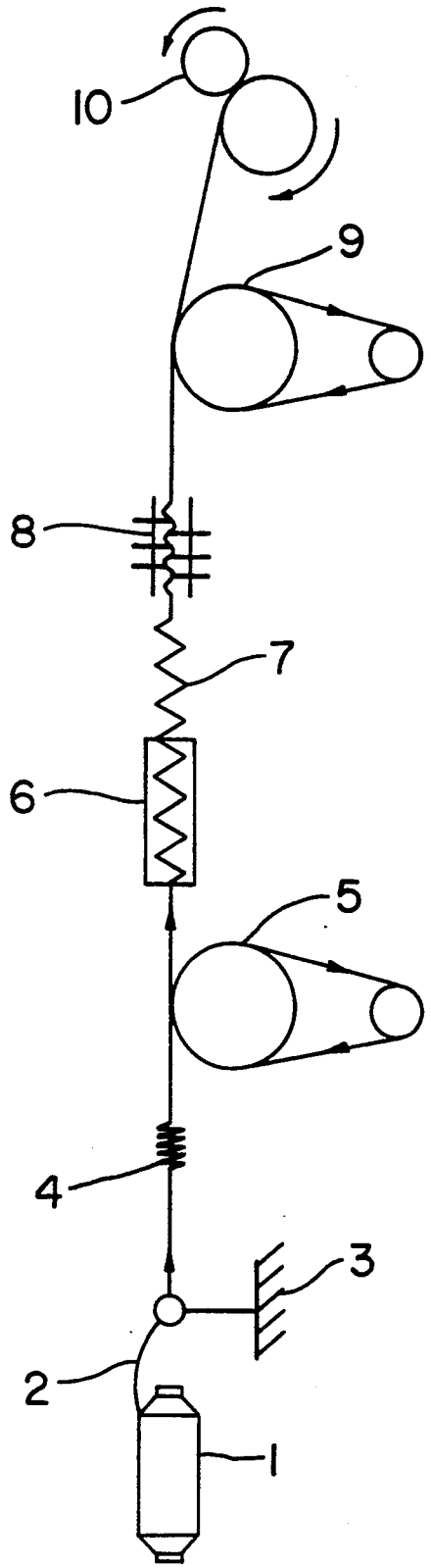
FIG. 1 a schematic process diagram.

According to FIG. 1, the reference numeral 1 designates a supply spool. A multifilament yarn 2 is guided via a yarn guide 3 and a yarn brake 4 at a speed of passage of 200 m/min and twisted up by a friction-twist-unit 8 between a first feeder roll 5 and a second feeder roll 9. The yarn is elongated between the two feeder rolls 5 and 9. A contact heater 6 is disposed downstream of the feeder roll. Both feeder rolls operate at the same speed. The yarn 7 which backs up is subjected to heat setting in the contact heater 6 which is heated to 180° C. and subsequently, it is guided through the geometry of the friction disks of the friction twist unit 8. The positive feed from the friction unit 8 permits operation at a higher tension before and at a lower tension after the friction twist unit 8. After the second feeder roll 9, the textured yarn 7 is wound up on a cylinder of the take-up spool 10.

Figure 2:
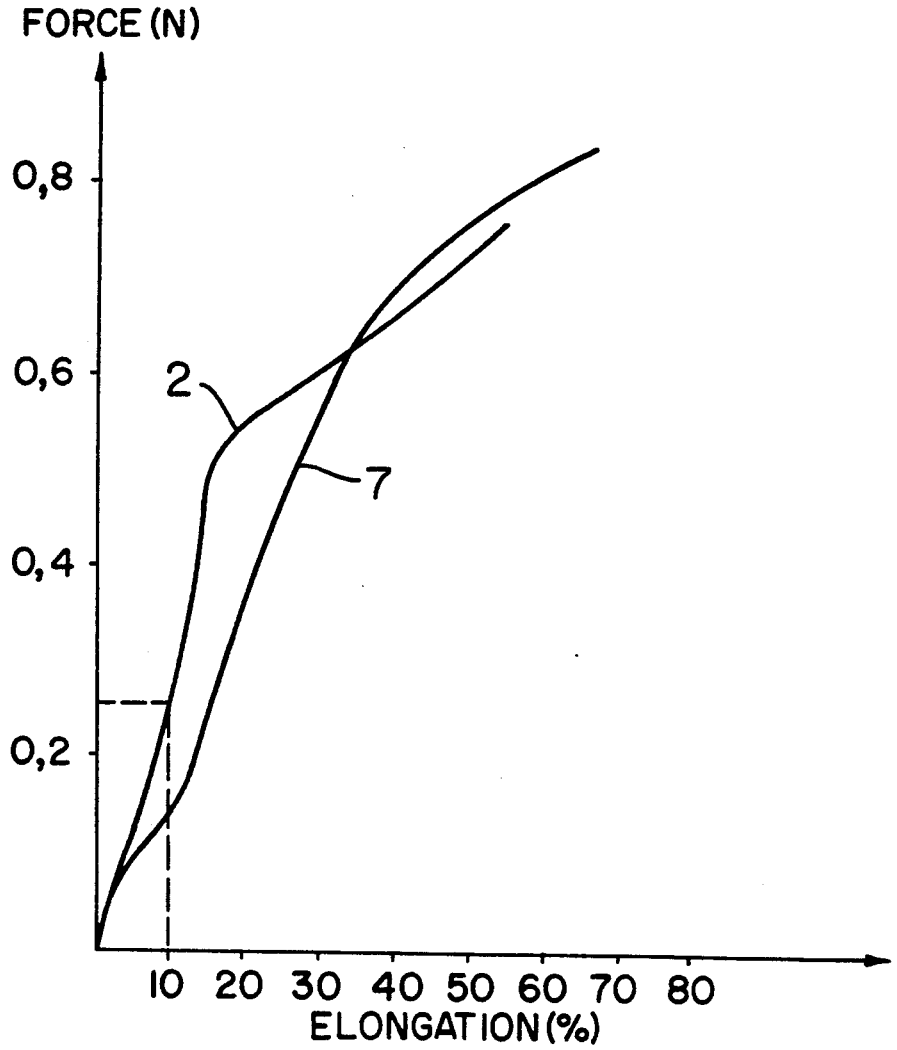
FIG. 2 force-elongation curves of a polyetherester-elastomeric yarns made of polymer A, FIG. 3 force-elongation curves of polyetherester-elastomeric yarns made of polymer B.
Figure 3:
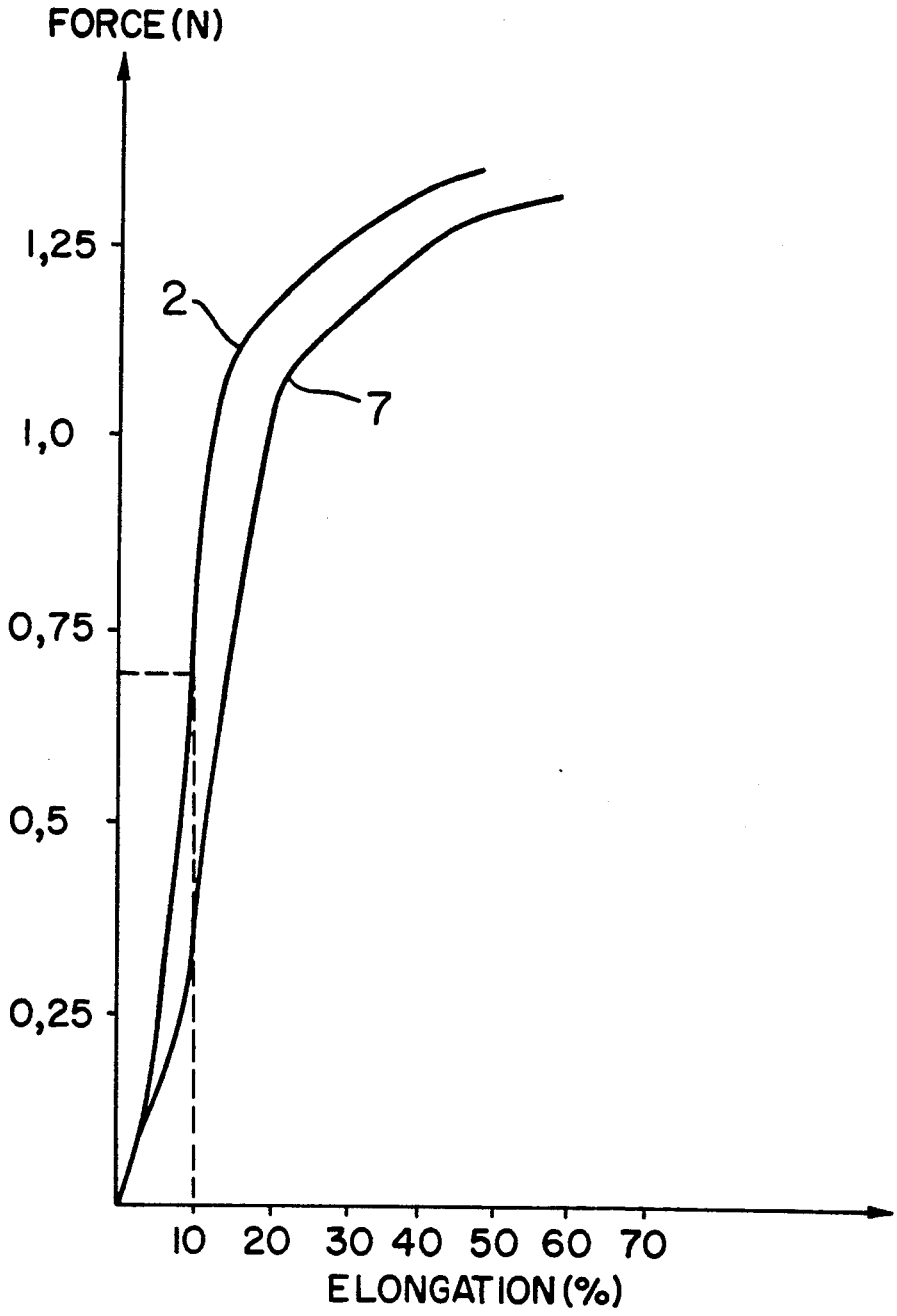

FIG. 2 shows the force-elongation curves of the flat elastomeric yarn 2 and of the textured elastomeric yarn 7 of polymer A; FIG. 3 shows the corresponding strength-elongation curves of polymer B.

All texturing tests were carried out on a SCRAGG CS12-test apparatus which is equipped with friction units for the manufacture of highly elastic polyamide textured yarn. The friction unit has the configuration 1/5/1. The external disks which serve to guide the yarn are chromium-plated, and the five center disks are make of polyurethane.

The test results with two different polymers are summarized in the following table. Polymer A consists of polybutyleneterephthalate and polybutyleneglycol blocks and polymer B consists of polyethleneterephthalate and polethyleneglycol blocks.

| | |
|---|---|
| Texturing conditions: | SCRAGG CS12-600 |
| Processing speed | 200 m/min |
| Twist contraction | 0% |
| D/Y-ratio | 1.45:1 |
| Temperature | 180° C. |
| Friction disks | 1/5/1 polyurethane |

Results

TABLE

| | | dtex 31 f 8 Polyester A | | dtex 50 f 14 Polyester B | |
|---|---|---|---|---|---|
| | | flat | textured | flat | textured |
| Titer | dtex | 31.5 | 32.8 | 50.8 | 54.7 |
| Initial Modulus | cN/tex | 82 | . | 136 | . |
| Strength | cN/tex | 24 | 26 | 27 | 24 |
| Breaking Elongation | % | 57 | 67 | 54 | 64 |
| Permanent Elongation | % | 15 | . | 10 | . |
| Degree of Crimp | % | . | 60 | . | 42 |
| Crimp Resistance | % | . | 71 | . | 67 |
| Yarn Tension | | | | | |
| Before Spindle | cN | . | 3.7 | . | 4.5 |
| After Spindle | cN | . | 2.5 | . | 2.8 |

The initial modulus is calculated based on the force-elongation diagram (see FIG. 2 or 3).

$$\text{initial modulus } [cN/tex] = \frac{\text{force at 10\% elongation } [cN] \times 10}{\text{Titer } [tex]}$$

The breaking elongation can be calculated from the force-elongation diagram (=elongation in %) and the titer is used to calculate the strength.

The degree of crimp and the crimp resistance are determined using Texturmat according to DIN 53840.

The permanent elongation is obtained from the elongation hysteresis. Without interruption, the sample is elongated 5 times up to 80% of its breaking elongation, and the tension is released. Subsequently, there is a 2 minute pause in tension free condition until the sample is again subjected to elongation. The elongation at the point when force is applied is referred to as permanent elongation.

The textured yarns thus obtained, which have good elastic properties, are particularly suited for stockings, elastic fabrics for sportswear and outerwear. But also hosiery and knitted goods of all kinds can be manufactured with the yarn in accordance with the invention.

The yarns in accordance with the invention can be used as plating yarns for manufacturing bielastic knitted goods for sportswear. Alternative platings are possible by using polyamide, polyester, cotton or viscose as a core thread. The relatively low melting point of the elastic bulk yarn can be advantageously utilized for the plating.

We claim:

1. The method of manufacturing a friction-textured elastic yarn, which comprises twisting a single-component multifilament melt-spinnable polymer yarn selected from the group consisting of polyester, polyether ester, polyether ester amide and polyether amide yarns having an initial modulus of 80 to 150 cN/tex and a melting point of a least 200° C. at a speed of at least 200 m/min, heat-setting the twisted yarn at 160° to 190° C. to produce a fixated yarn, and friction-texturing said fixated yarn while at the same time subjecting said fixated yarn to a pretension of 0.5 to 3.0 cN/tex.

* * * * *